US010156822B2

(12) United States Patent
Nimura et al.

(10) Patent No.: US 10,156,822 B2
(45) Date of Patent: Dec. 18, 2018

(54) IMAGE FORMING APPARATUS THAT FORMS IMAGE ON SHEET

(71) Applicant: KYOCERA Document Solutions Inc., Osaka (JP)

(72) Inventors: Eiji Nimura, Osaka (JP); Koji Kuramashi, Osaka (JP); Sueaki Okamoto, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/899,693

(22) Filed: Feb. 20, 2018

(65) Prior Publication Data

US 2018/0239283 A1 Aug. 23, 2018

(30) Foreign Application Priority Data

Feb. 21, 2017 (JP) ..... 2017-030088

(51) Int. Cl.
*G03G 15/00* (2006.01)
*G03G 15/08* (2006.01)

(52) U.S. Cl.
CPC ..... *G03G 15/502* (2013.01); *G03G 15/08* (2013.01); *G03G 2215/0697* (2013.01)

(58) Field of Classification Search
CPC ..... G03G 15/5016; G03G 15/502; G03G 2215/0697
See application file for complete search history.

(56) References Cited

U.S. PATENT DOCUMENTS 7,330,671 B2 * 2/2008 Takahashi ..... G03G 15/55 399/12
2005/0254831 A1 * 11/2005 Soga ..... G03G 15/50 399/12
2005/0254832 A1 * 11/2005 Kumai ..... G03G 15/556 399/12
2005/0254833 A1 * 11/2005 Yokoe ..... G03G 15/55 399/12
2005/0254836 A1 * 11/2005 Takei ..... G03G 15/50 399/12
2005/0254839 A1 * 11/2005 Nagamine ..... G03G 15/553 399/12

(Continued)

FOREIGN PATENT DOCUMENTS

JP 2011-028017 A 2/2011

*Primary Examiner* — Carla J Therrien
(74) *Attorney, Agent, or Firm* — IP Business Solutions, LLC

(57) ABSTRACT

An image forming apparatus includes a transport unit, an image forming unit, an output tray, a toner container, and a processor that realizes a function of a conformity decision unit, a change reception unit, and a controller. The controller discharges, when the conformity decision unit decides that the toner container is not a conforming product, a quality check sheet to the output tray each time a predetermined number of sheets have been printed, or each time a predetermined time has elapsed. The change reception unit receives a change of a quality adjustment value from a user. The controller controls the operation of the transport unit and the image forming unit, according to the quality adjustment value that has been changed and received by the change reception unit.

14 Claims, 12 Drawing Sheets

(56) References Cited

U.S. PATENT DOCUMENTS

| | | | | |
|---|---|---|---|---|
| 2010/0097624 | A1* | 4/2010 | Hirakawa | G03G 15/5062 358/1.12 |
| 2010/0290791 | A1* | 11/2010 | Sonoda | G03G 15/55 399/12 |
| 2012/0002994 | A1* | 1/2012 | Moroney | G03G 15/5016 399/72 |

* cited by examiner

Fig.6A

| BACKGROUND ADJUSTMENT VALUE | SURFACE POTENTIAL OF PHOTOCONDUCTOR DRUM (V) |
|---|---|
| LIGHTER −3 | 280 |
| −2 | 260 |
| −1 | 240 |
| ±0 | 220 |
| +1 | 200 |
| +2 | 180 |
| DARKER +3 | 160 |

Fig.6B

| DENSITY ADJUSTMENT VALUE | AC VOLTAGE Vpp (V) |
|---|---|
| LIGHTER −3 | 1175 |
| −2 | 1225 |
| −1 | 1275 |
| ±0 | 1325 |
| +1 | 1375 |
| +2 | 1425 |
| DARKER +3 | 1475 |

Fig.6C

| FINE LINE ADJUSTMENT VALUE | DC VOLTAGE Vdc (V) |
|---|---|
| LIGHTER − 3 | 90 |
| − 2 | 105 |
| − 1 | 120 |
| ± 0 | 135 |
| + 1 | 150 |
| + 2 | 165 |
| DARKER + 3 | 170 |

IMAGE FORMING APPARATUS THAT FORMS IMAGE ON SHEET

INCORPORATION BY REFERENCE

This application claims priority to Japanese Patent Application No. 2017-030088 filed on Feb. 21, 2017, the entire contents of which are incorporated by reference herein.

BACKGROUND

The present disclosure relates to an image forming apparatus that forms an image on a sheet, and more particularly to a technique to control the operation when a non-conforming toner container is mounted.

Existing image forming apparatuses generally include a photoconductor drum serving as an image carrier, a charging device that electrically charges the photoconductor drum, an exposure device emits a laser beam based on a source document onto the surface of the electrically charged photoconductor drum, to thereby form a latent image of the source document on the surface of the photoconductor drum, a developing device that visualizes the latent image with a toner, a transfer roller for transferring the visualized toner image onto a sheet, a fixing device that fixes the transferred toner image on the sheet, and a cleaning device that removes residual toner on the surface of the photoconductor drum.

In recent years, non-conforming toner containers have come to be widely used. Some of the non-conforming products exhibit different performance from conforming products, and hence the use of the non-conforming toner container may lead to degraded performance of the image forming apparatus.

Accordingly, proposals have been made to urge a user to utilize the conforming toner container, for example by deciding whether a toner container mounted in the image forming apparatus is a conforming product, with a wireless tag attached to the toner container and a radio frequency identification (RFID) communication unit provided in the main body of the image forming apparatus, and displaying a warning message on a display panel, notifying the user to the effect that the non-conforming toner container has been mounted, upon deciding that the mounted toner container is the non-conforming product.

SUMMARY

The disclosure proposes further improvement of the foregoing technique.

In an aspect, the disclosure provides an image forming apparatus including a transport unit, an image forming unit, an output tray, a toner container, and a processor. The transport unit includes a roller pair that transports a sheet, and a transport route on which the roller pair is provided. The image forming unit includes an image carrier that rotates about a rotation shaft and carries a toner image on a surface, and a developing device that forms the toner image on the surface of the image carrier by supplying toner to the image carrier, and forms an image on the sheet. The output tray receives the sheet on which the image has been formed by the image forming unit. The toner container is removably mounted in a main body and stores the toner used by the image forming unit to form the image. The processor realizes a function of a conformity decision unit, a change reception unit, and a controller. The conformity decision unit decides whether the toner container mounted in the main body is a conforming product. The change reception unit receives a change of a quality adjustment value from a user. The controller causes the transport unit and the image forming unit, when the conformity decision unit decides that the toner container mounted in the main body is not a conforming product, to discharge a quality check sheet, formed by printing at least one of a predetermined image pattern and a predetermined message on the sheet, to the output tray, each time a predetermined number of sheets have been printed, or each time a predetermined time has elapsed. The predetermined image pattern is for indicating a quality level of the image formed on the sheet. The predetermined message is for urging the user to adjust the quality of the image formed on the sheet. The controller controls the transport unit and the image forming unit according to the quality adjustment value that has been changed and received by the change reception unit.

BRIEF DESCRIPTION OF THE DRAWINGS

FIG. 6A is a table showing a relationship between a background adjustment value and a surface potential of the photoconductor drum.

FIG. 6B is a table showing a relationship between a density adjustment value and a magnitude of the AC component of the development bias.

FIG. 6C is a table showing a relationship between a fine line adjustment value and a magnitude of the DC component of the development bias.

DETAILED DESCRIPTION

Figure 1:
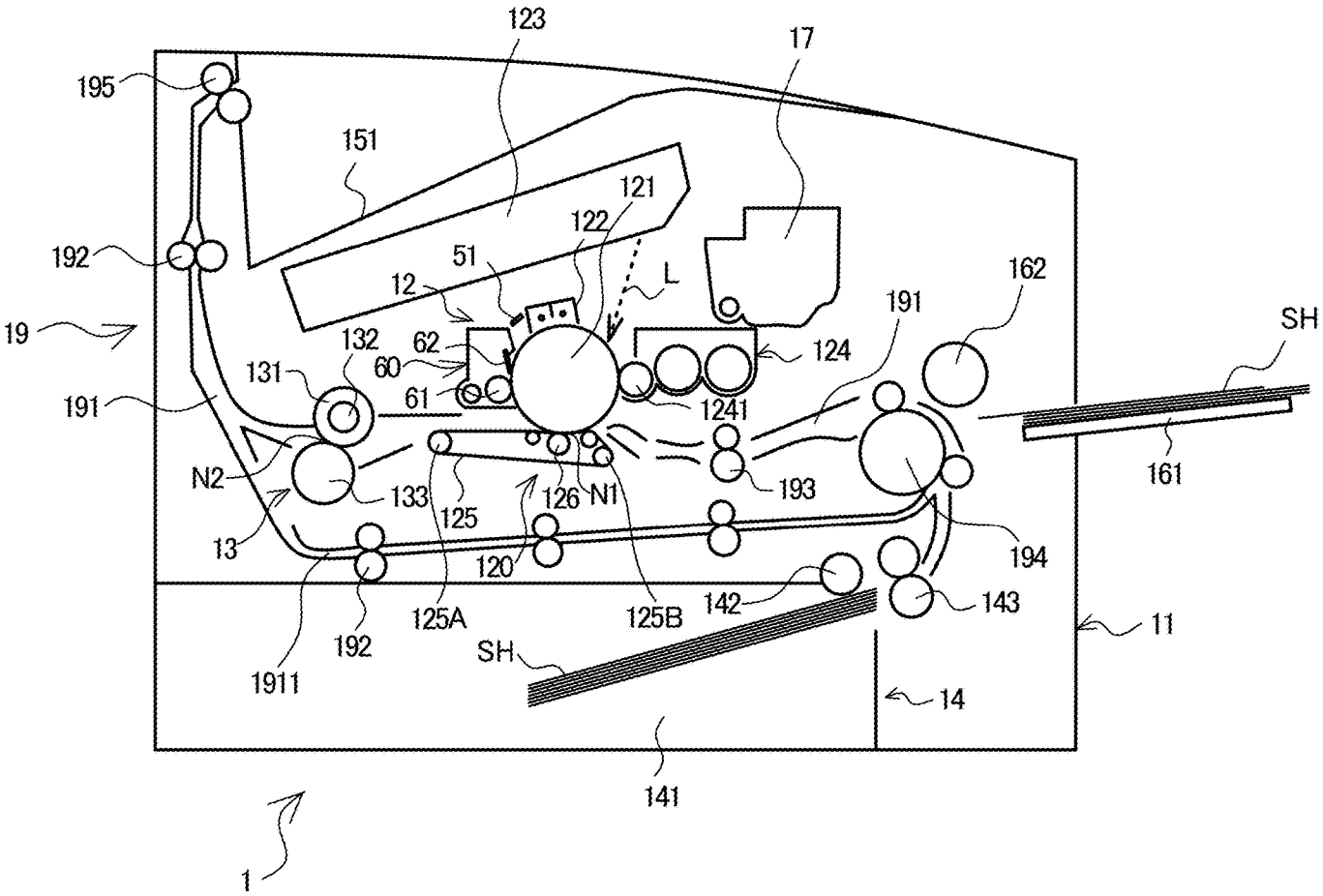
FIG. 1 is a schematic side cross-sectional view showing a configuration of an image forming apparatus according to a first embodiment of the disclosure.

Hereafter, an image forming apparatus according to embodiments of the disclosure will be described with reference to the drawings. FIG. 1 is a schematic side cross-sectional view showing a configuration of the image forming apparatus according to a first embodiment of the disclosure. The image forming apparatus 1 is for example a printer, and includes a paper feed unit 14, an image forming unit 12, a toner container 17, a fixing unit 13, an output tray 151, and a bypass tray 161, which are located inside a main body 11. The image forming apparatus 1 also includes a transport unit 19 that transports a sheet SH from the paper feed unit 14 to the output tray 151, through the image forming unit 12 and the fixing unit 13.

The transport unit 19 includes a transport route 191 connecting between the paper feed unit 14 and the output tray 151, a reverse transport route 1911, a plurality of transport roller pairs 192 located at predetermined positions on the transport route 191 and the reverse transport route 1911, a resist roller pair 193, a transport drum 194, and a discharge roller pair 195.

The paper feed unit 14 is located in the bottom portion of the main body 11, and includes a paper feed cassette 141 for storing a plurality of sheets SH, a first pickup roller 142 for picking up the sheets SH stored in the paper feed cassette 141 one by one, and a feed roller pair 143 for feeding the sheet SH picked up by the first pickup roller 142, to the transport route 191. The sheet SH may be, for example, a paper sheet, an OHP film, or an envelope.

The sheet SH fed by the feed roller pair 143 is delivered to the transport route 191 through the transport drum 194. The sheet SH delivered to the transport route 191 is supplied to the image forming unit 12, by the resist roller pair 193.

The image forming unit 12 is located above the paper feed cassette 141, and includes a photoconductor drum 121, a charging device 122, an exposure device 123, a developing device 124, a transfer unit 120, a cleaning device 60, and a static elimination device 51.

The photoconductor drum 121 serves as an image carrier that carries a toner image on the surface thereof, and is configured to rotate about a rotation shaft. The charging device 122 electrically charges the surface of the photoconductor drum 121. The exposure device 123 emits a laser beam L based on image data transmitted from an external device (e.g., personal computer), to thereby from a latent image on the surface of the photoconductor drum 121.

The developing device 124 includes a developing roller 1241, and visualizes the latent image formed on the surface of the photoconductor drum 121, with the toner.

The transfer unit 120 includes a transport belt 125 that transports the sheet SH, a drive roller 125A, a slave roller 125B, and a transfer roller 126.

The transport belt 125 is spanned between the drive roller 125A and the slave roller 125B, and driven by the drive roller 125A in contact with the surface of the photoconductor drum 121, so as to endlessly run in synchronization with the photoconductor drum 121. In addition, a transfer roller 126 is provided in contact with the surface of the photoconductor drum 121, with the transport belt 125 pinched therebetween, at the position where the toner image is transferred from the photoconductor drum 121 to the sheet SH, and a transfer nip region N1 is formed between the transfer roller 126 and the photoconductor drum 121.

The cleaning device 60 includes a cleaning roller 61 and a cleaning blade 62. The cleaning roller 61 and the cleaning blade 62 are disposed in contact with the surface of the photoconductor drum 121, so as to clean the surface of the photoconductor drum 121, by removing residual toner and substances stuck to the surface of the photoconductor drum 121.

The static elimination device 51 serves to eliminate the electric charge remaining on the surface of the photoconductor drum 121, by emitting a static elimination light onto the surface of the photoconductor drum 121, after the image formation by the image forming unit 12.

The toner container 17, removably mounted in the main body 11, stores the toner to be consumed by the image forming unit 12 and supplies the toner to the developing device 124.

The fixing unit 13, which serves to fix the toner image to the sheet SH by thermal compression, includes a heating roller 131 having a built-in heat lamp 132 that serves as a heat source, and a pressure roller 133. The heating roller 131 and the pressure roller 133 constitute a pair, such that the unfixed toner image is melted by the heat of the heat lamp 132 when the sheet SH is pinched in a fixing nip region N2 between the heating roller 131 and the pressure roller 133, and is fixed to the sheet SH by the pressure of the heating roller 131 and the pressure roller 133.

The sheet SH, which has undergone the fixing process, is transported upward along the transport route 191, and discharged to the output tray 151 located on an upper side of the main body 11, through the discharge roller pair 195.

For example, the image forming apparatus 1 performs duplex printing as follows. The sheet SH, having an image formed on a surface thereof by the image forming unit 12 is pinched between the discharge roller pair 195 and then switched back by the discharge roller pair 195 to be delivered to the reverse transport route 1911 and transported by the transport drum 194 to the transport route 191. Then the sheet SH is again supplied to the image forming unit 12 by the resist roller pair 193. Thus, an image is also formed on the other surface of the sheet SH.

The bypass tray 161 is located on the front side of the main body 11, to place the sheets SH. The sheets SH placed on the bypass tray 161 are picked up by the second pickup roller 162 one by one, and delivered to the transport route 191.

Figure 2:
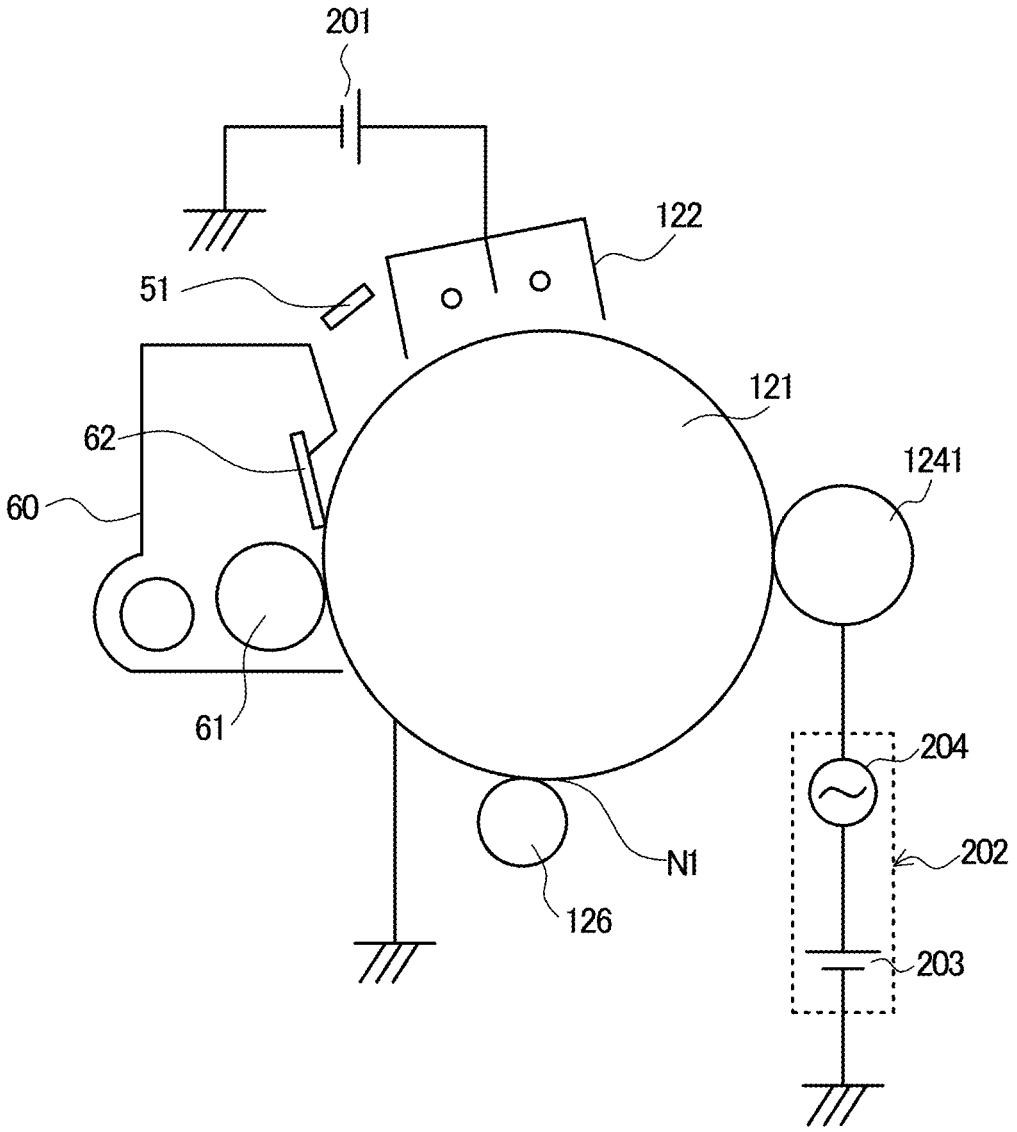
FIG. 2 is a schematic side cross-sectional view showing a photoconductor drum and peripheral components in the image forming apparatus.

FIG. 2 is an enlarged side cross-sectional view showing the photoconductor drum 121 and peripheral components in the image forming apparatus 1. The photoconductor drum 121 is grounded. The charging device 122 is connected to a charge bias supply unit 201, constituted of a DC power source, so that the charge bias supply unit 201 supplies a DC voltage to the charging device 122, as a charge bias voltage. The surface potential of the photoconductor drum 121 varies depending on the charge bias voltage supplied to the charging device 122.

Figure 3:
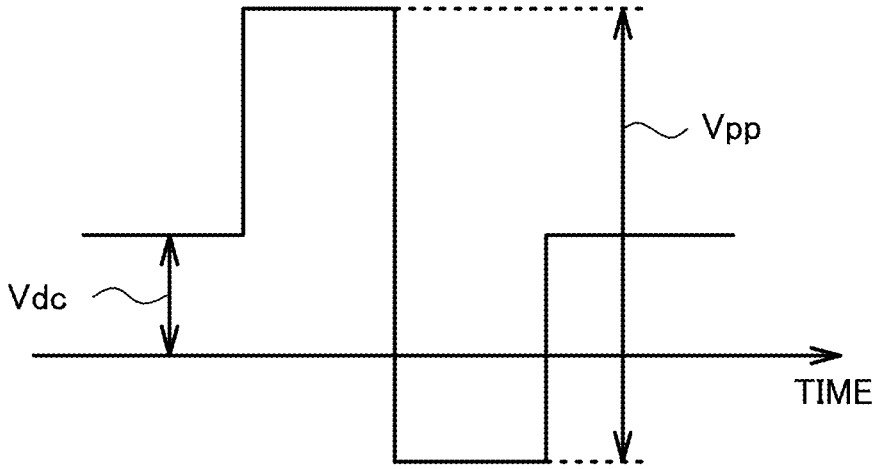
FIG. 3 is a diagram showing an example of a waveform of development bias applied to the photoconductor drum and a developing roller.

The developing roller 1241 is connected to a development bias supply unit 202 constituted of a DC power source 203 and an AC power source 204, so that the development bias supply unit 202 supplies a superimposed voltage of a DC voltage and an AC voltage to the developing roller 1241, as a development bias voltage. Here, FIG. 3 is a diagram showing an example of the waveform of the development bias applied to the photoconductor drum 121 and the developing roller 1241, in which a voltage Vdc represents the DC voltage, and a voltage Vpp represents the AC voltage (peak-to-peak voltage).

Increasing the difference between the surface potential of the photoconductor drum 121 and the development bias potential facilitates the toner to stick to the surface of the photoconductor drum 121, thereby making the background darker. To make the background lighter, therefore, the surface potential of the photoconductor drum 121 may be increased, to reduce the difference between the surface potential and the development bias potential.

In addition, the surface potential of the photoconductor drum 121 increases in proportion to a charging bias potential supplied to the charging device 122, and therefore the background density can be adjusted, also by controlling the operation of the charge bias supply unit 201.

Further, the density of the image formed on the sheet SH varies depending on the AC voltage constituting the development bias voltage, and the density (thickness) of fine lines varies depending on the DC voltage constituting the development bias voltage. Therefore, the image density and fine lines can be adjusted, by controlling the operation of the development bias supply unit 202.

Figure 4:
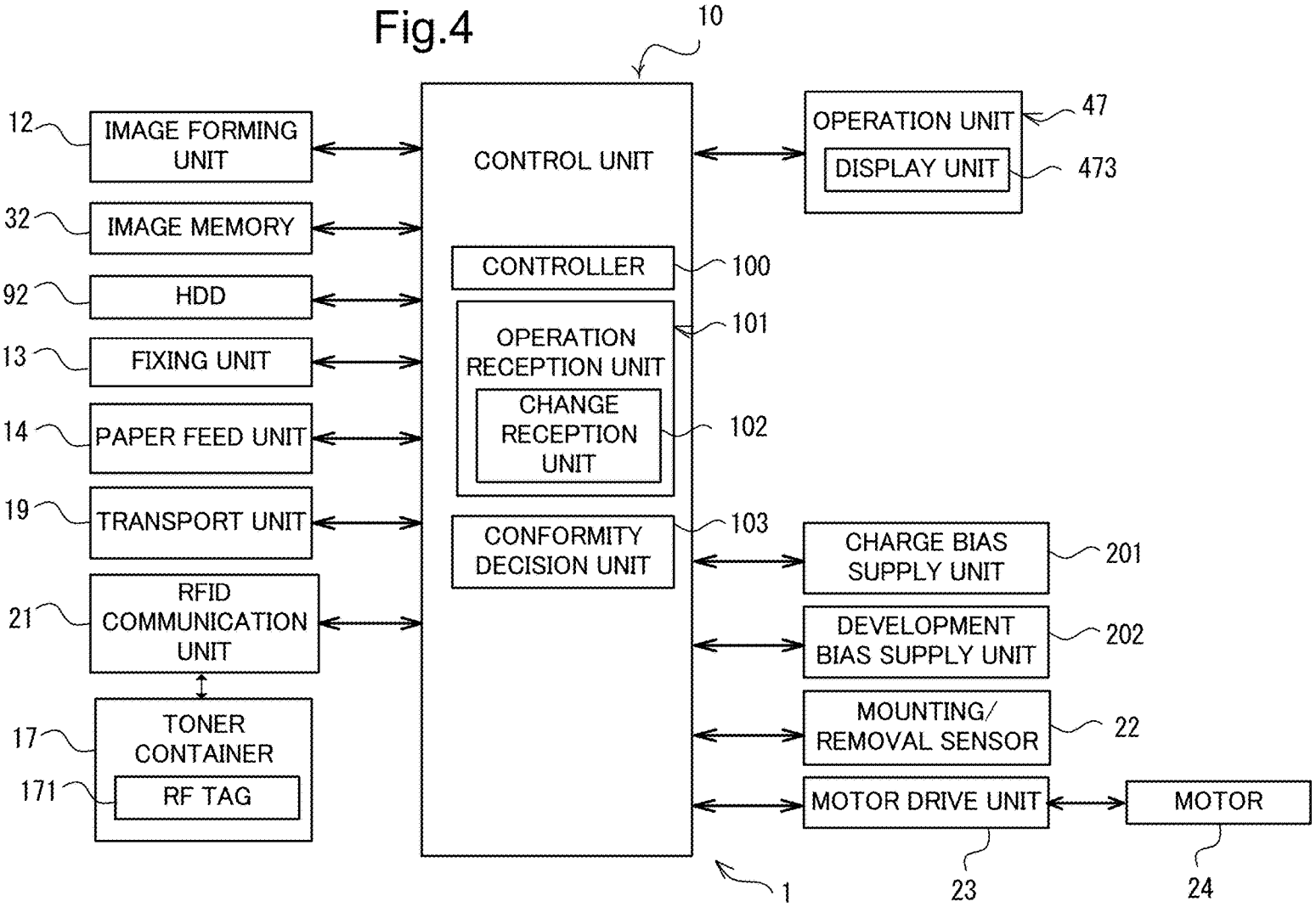
FIG. 4 is a functional block diagram showing an outline of the internal configuration of the image forming apparatus according to the first embodiment.

FIG. 4 is a functional block diagram showing an outline of the internal configuration of the image forming apparatus 1. The image forming apparatus 1 includes a control unit 10, the image forming unit 12, an image memory 32, a hard disk drive (HDD) 92, the fixing unit 13, the paper feed unit 14, the transport unit 19, a RFID communication unit 21, the toner container 17, an operation unit 47, the charge bias supply unit 201, the development bias supply unit 202, a mounting/removal sensor 22, a motor drive unit 23, and a motor 24. The components that are similar to those of the image forming apparatus 1 shown in FIG. 1 and FIG. 2 are given the same numeral, and the description thereof will not be repeated.

The image memory 32 is a region for temporarily storing image data transmitted from an external device (e.g., personal computer), and image data representing an image to be printed by the image forming unit 12. The HDD 92 is a large-capacity storage device for storing the image data and other data.

The RFID communication unit 21 makes communication with a RF tag 171 attached to the toner container 17 removably mounted in the main body 11. The RF tag 171 includes a memory for storing product information of the toner container 17. When the toner container 17 is mounted in the main body 11, the RFID communication unit 21 and the RF tag 171 are located within a mutually communicable range. In this state, the RFID communication unit 21 receives a signal outputted from the RF tag 171, to thereby acquire the product information of the toner container 17.

The operation unit 47 receives instructions from the user to execute, for example, the image forming, with respect to the operations and processes that the image forming apparatus 1 is configured to perform. The operation unit 47 includes a display unit 473 for displaying operation guides and so forth to the user. The display unit 473 includes a touch panel, to allow the user to operate the image forming apparatus 1 by touching buttons and keys displayed on the screen.

The mounting/removal sensor 22 includes, for example, a switch that mechanically turns on and off. The switch of the mounting/removal sensor 22 is turned on when the toner container 17 is mounted in the main body 11, and turned off when the toner container 17 is removed from the main body 11. The mounting/removal sensor 22 detects the mounting and removal of the toner container 17 in and from the main body 11, according to the on and off state of the switch.

The motor drive unit 23 controls the operation of the motor 24 according to an instruction from a controller 100, to be subsequently described, in the control unit 10. The motor 24 serves as a drive source that supplies rotational force to the transport roller pair 192, the resist roller pair 193, the transport drum 194, the discharge roller pair 195, the first pickup roller 142, the feed roller pair 143, the photoconductor drum 121, the drive roller 125A, the transfer roller 126, the cleaning roller 61, the heating roller 131, the pressure roller 133, and the second pickup roller 162. Alternatively, the mentioned rollers and drums may each possess a motor as the drive source, and the motor drive unit 23 may be provided for each motor.

The control unit 10 includes a processor, a random-access memory (RAM), a read-only memory (ROM), and an exclusive hardware circuit. The processor may be, for example, a central processing unit (CPU), an application specific integrated circuit (ASIC), or a micro processing unit (MPU). The control unit 10 includes a controller 100, an operation reception unit 101, and a conformity decision unit 103.

The control unit 10 acts as the controller 100, the operation reception unit 101, and the conformity decision unit 103, when the processor executes a control program stored in the HDD 92. Here, the controller 100 and other components may each be constituted of a hardware circuit, instead of being realized by the operation of the control unit 10 based on the control program. This also applies to subsequent embodiments, unless otherwise specifically noted.

The controller 100, which serves to control the overall operation of the image forming apparatus 1, is connected to the image forming unit 12, the image memory 32, the HDD92, the fixing unit 13, the paper feed unit 14, the transport unit 19, the RFID communication unit 21, the operation unit 47, the charge bias supply unit 201, the development bias supply unit 202, the mounting/removal sensor 22, and the motor drive unit 23, to control the operation of the mentioned components.

Figure 5:
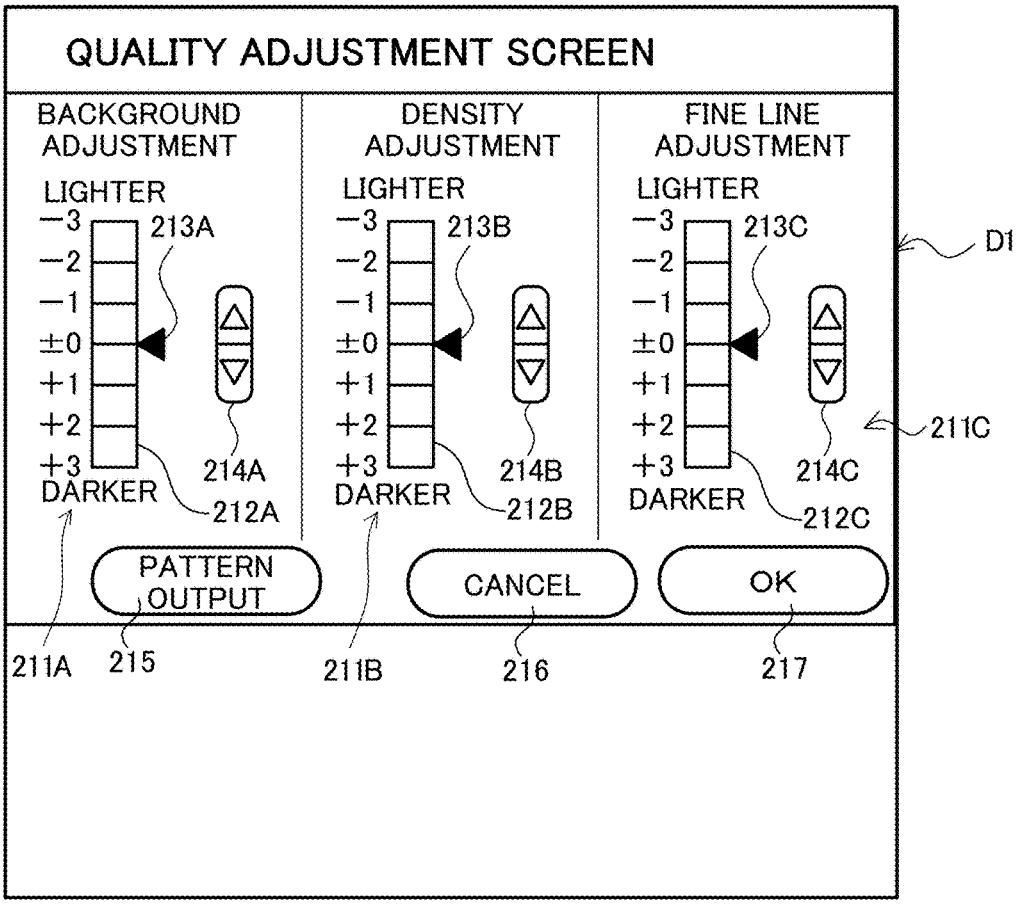
FIG. 5 is a schematic drawing showing an example of a screen displayed on a display unit.

The operation reception unit 101 receives an input made by the user through the operation unit 47. The operation reception unit 101 also includes a change reception unit 102 for receiving a change of a quality adjustment value made by the user. For example, the change reception unit 102 causes the display unit 473 to display a quality adjustment screen D1 shown in FIG. 5. The change reception unit 102 may receive the change of the quality adjustment value made by the user, for example through a touch panel function provided to the display unit 473 acting as a part of the operation unit 47.

In the quality adjustment screen D1, a background adjustment screen 211A, a density adjustment screen 211B, and a fine line adjustment screen 211C are displayed at the same time. The background adjustment screen 211A, the density adjustment screen 211B, and the fine line adjustment screen 211C respectively include scales 212A to 212C, markers 213A to 213C located beside the scales 212A to 212C, and arrow buttons 214A to 214C for moving the markers 213A to 213C stepwise, upward or downward. Further, operation buttons 215 to 217, respectively indicating PATTERN OUTPUT, CANCEL, and OK, are provided.

When the user operates the arrow buttons 214A to 214C to move the markers 213A to 213C, the change reception unit 102 of the operation reception unit 101 receives the instruction whether to lighten or darken the background, lighten or darken the image density, and lighten (make finer) or darken (make bolder) the fine lines.

In other words, the change reception unit 102 receives a change of the quality adjustment value, namely the background adjustment value, the density adjustment value, and the fine line adjustment value, inputted by the user, and stores the change. The controller 100 controls the operation of the image forming unit 12, according to the quality adjustment value stored in the change reception unit 102. For example, the controller 100 controls the charge bias supply unit 201 according to the background adjustment value received by the change reception unit 102, so as to adjust the surface potential of the photoconductor drum 121, thus to adjust the background.

Likewise, the controller 100 controls the development bias supply unit 202 according to the density adjustment value and the fine line adjustment value received by the change reception unit 102, so as to adjust the AC component and the DC component of the development bias applied between the photoconductor drum 121 and the developing roller 1241, thus to adjust the density and the fine line.

Further, when the change reception unit 102 receives the input made by the user through the operation button 215 (see FIG. 5), the controller 100 controls the operation of the image forming unit 12 according to the quality adjustment value stored in the change reception unit 102, so as to make out a quality check sheet including image patterns for indicating the quality level of the image to be formed on the sheet SH, and to discharge the quality check sheet to the output tray 151. The image patterns may be formed as image patterns G1 to G3 shown in FIG. 8 to FIG. 10, which will be subsequently described in detail.

FIG. 6A to FIG. 6C are tables each showing a relationship between the quality adjustment value and the control value. FIG. 6A represents a relationship between the background adjustment value and the surface potential of the photoconductor drum 121. FIG. 6B represents a relationship between the density adjustment value and the magnitude of the AC component of the development bias (peak-to-peak voltage Vpp shown in FIG. 3). FIG. 6C represents a relationship between the fine line adjustment value and the magnitude of the DC component of the development bias (DC voltage Vdc shown in FIG. 3).

According to the mentioned tables, when the background adjustment value stored in the change reception unit 102 is, for example, set to −1, the controller 100 adjusts the surface potential of the photoconductor drum 121 to 240 V, by controlling the charge bias supply unit 201. Likewise, when the density adjustment value stored in the change reception unit 102 is set to +1, the controller 100 adjusts the peak-to-peak voltage to 1375 V, by controlling the AC power source 204 of the development bias supply unit 202. When the fine line adjustment value is set to −2, the controller 100 adjusts the DC voltage to 105 V by controlling the DC power source 203 of the development bias supply unit 202.

The conformity decision unit 103 decides whether the toner container 17 mounted in the main body 11 of the image forming apparatus 1 is a conforming product. The conformity decision unit 103 decides that the toner container 17 is a conforming product, when the RFID communication unit 21 acquires the information indicating that the container 17 is a conforming product, out of the product information of the toner container 17, by communicating with the RF tag 171 when the toner container 17 is mounted in the main body 11. On the other hand, the conformity decision unit 103 decides that the toner container 17 is a non-conforming product, when the RFID communication unit 21 is unable to communicate with the RF tag 171 despite the toner container 17 being mounted in the main body 11, or when the information indicating that the container 17 is a conforming product is unable to be acquired.

Figure 7:
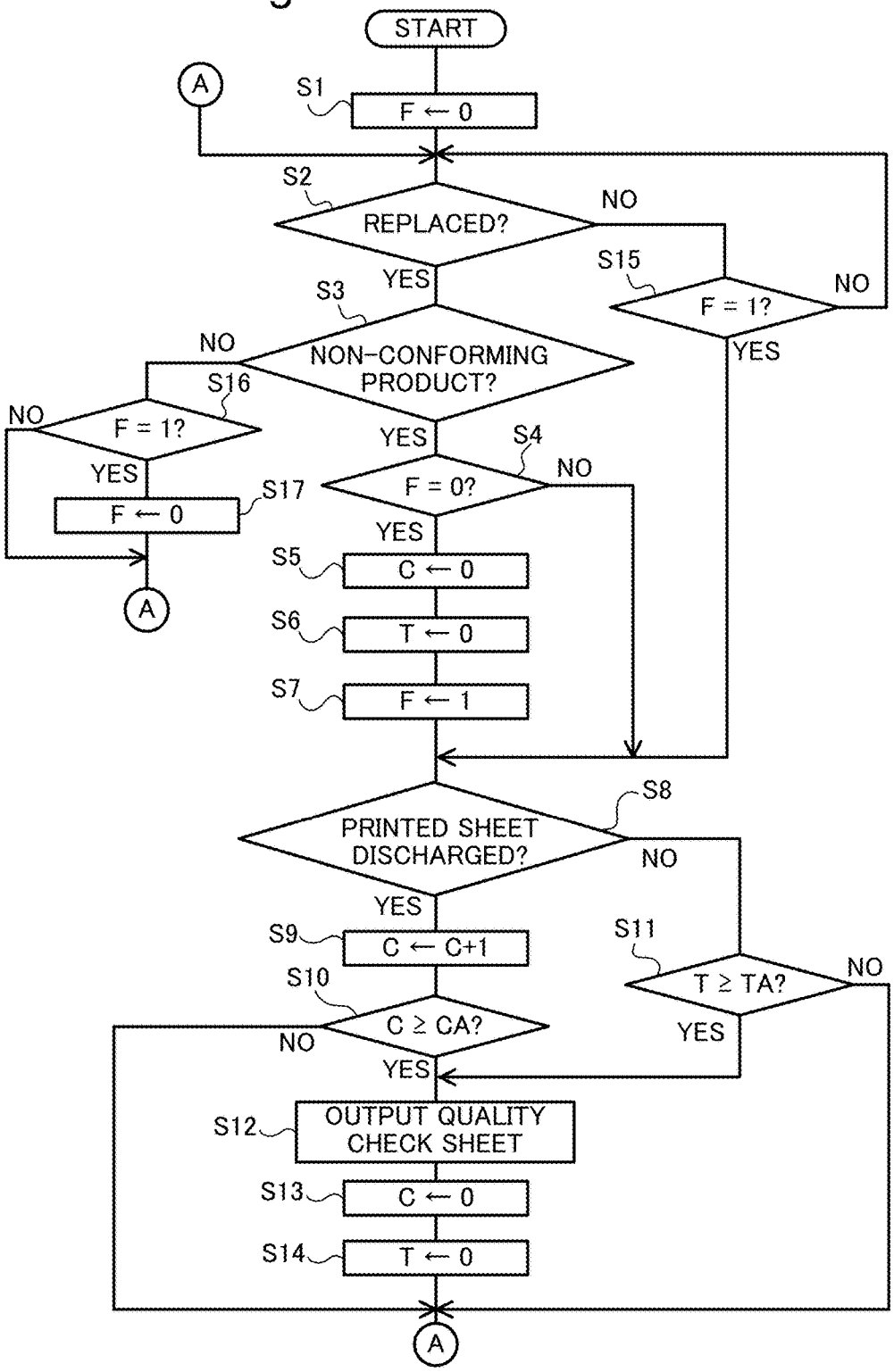
FIG. 7 is a flowchart showing an example of an operation performed by a control unit of the image forming apparatus according to the first embodiment.

Referring now to the flowchart shown in FIG. 7, an example of the operation performed by the control unit 10 of the image forming apparatus 1 according to the first embodiment will be described hereunder.

The controller 100 sets, as initial setting, a flag F indicating whether the toner container 17 mounted in the main body 11 is a conforming product, to 0 (0: conforming product, 1: non-conforming product) (S1). This is because the conforming toner container 17 is mounted in the main body 11, when the product is shipped from the plant.

Then, the controller 100 decides whether the toner container 17 has been replaced, according to the information acquired from the mounting/removal sensor 22 (S2). When the controller 100 decides that the toner container 17 has been replaced (YES at S2), the conformity decision unit 103 decides whether the toner container 17 mounted in the main body 11 is a non-conforming product, according to the information acquired from the RFID communication unit 21 (S3).

When the conformity decision unit 103 decides that the toner container 17 mounted in the main body 11 is a non-conforming product, (YES at S3), the controller 100 decides whether the flag F is 0 (S4).

When the controller 100 decides that the flag F is 0 (YES at S4), it can be assumed that the conforming toner container 17 mounted in the main body 11 has been replaced with the non-conforming product. At this point, the controller 100 resets a counter C, for counting the number of sheets printed, to 0 (S5). At the same time, the controller 100 resets a built-in timer T to 0 (S6), and sets the flag F to 1 (S7). Then the operation proceeds to S8.

In contrast, when the controller 100 decides that the flag F is not 0 (i.e., flag F is 1) (NO at S4), it can be assumed that the non-conforming toner container 17 mounted in the main body 11 has been replaced with another non-conforming product. Therefore, it is unnecessary to reset the counter C and the timer T to 0, and the flag F has already been set to 1. Accordingly, the operation directly proceeds to S8.

At S8, the controller 100 controls the operation of the image forming unit 12, to thereby decide whether the sheet SH, having an image formed thereon, has been discharged to the output tray 151 (S8). Upon deciding that the sheet SH has been discharged to the output tray 151 (YES at S8), the controller 100 adds 1 to the counter C (S9), and decides whether the counter C is indicating a predetermined number of sheets CA (e.g., 500 sheets) or more (S10).

Upon deciding that the counter C is indicating the predetermined number of sheets CA, in other words that the number of sheets printed has reached 500 (YES at S10), the controller 100 causes the image forming unit 12 to form the quality check sheet, and causes the transport unit 19 to discharge the quality check sheet to the output tray 151 (S12).

In contrast, upon deciding at S8 that the sheet SH having the image formed thereon has not been discharged to the output tray 151 (NO at S8), the controller 100 decides whether a predetermined period TA (e.g., 1 week) has elapsed in the timer T (S11). Upon deciding that the predetermined period TA has elapsed in the timer T, in other words 1 week has elapsed (YES at S11), the controller 100 generates and outputs the quality check sheet (S12).

At S12, the controller 100 controls the paper feed unit 14, the transport unit 19, the image forming unit 12, and the fixing unit 13, so as to form a predetermined image pattern and a predetermined message on the sheet SH, and discharge such sheet SH, serving as the quality check sheet, to the output tray 151.

Here, the predetermined image pattern is for indicating the quality level of the image to be formed on the sheet SH. The predetermined message is for urging the user to adjust the quality of the image to be formed on the sheet SH. The message includes, for example, a reason that the sheet SH has been discharged to the output tray 151 (e.g., the non-conforming toner container is used), and a quality adjustment method (e.g., steps to follow to reach the quality adjustment screen D1).

Figure 8:
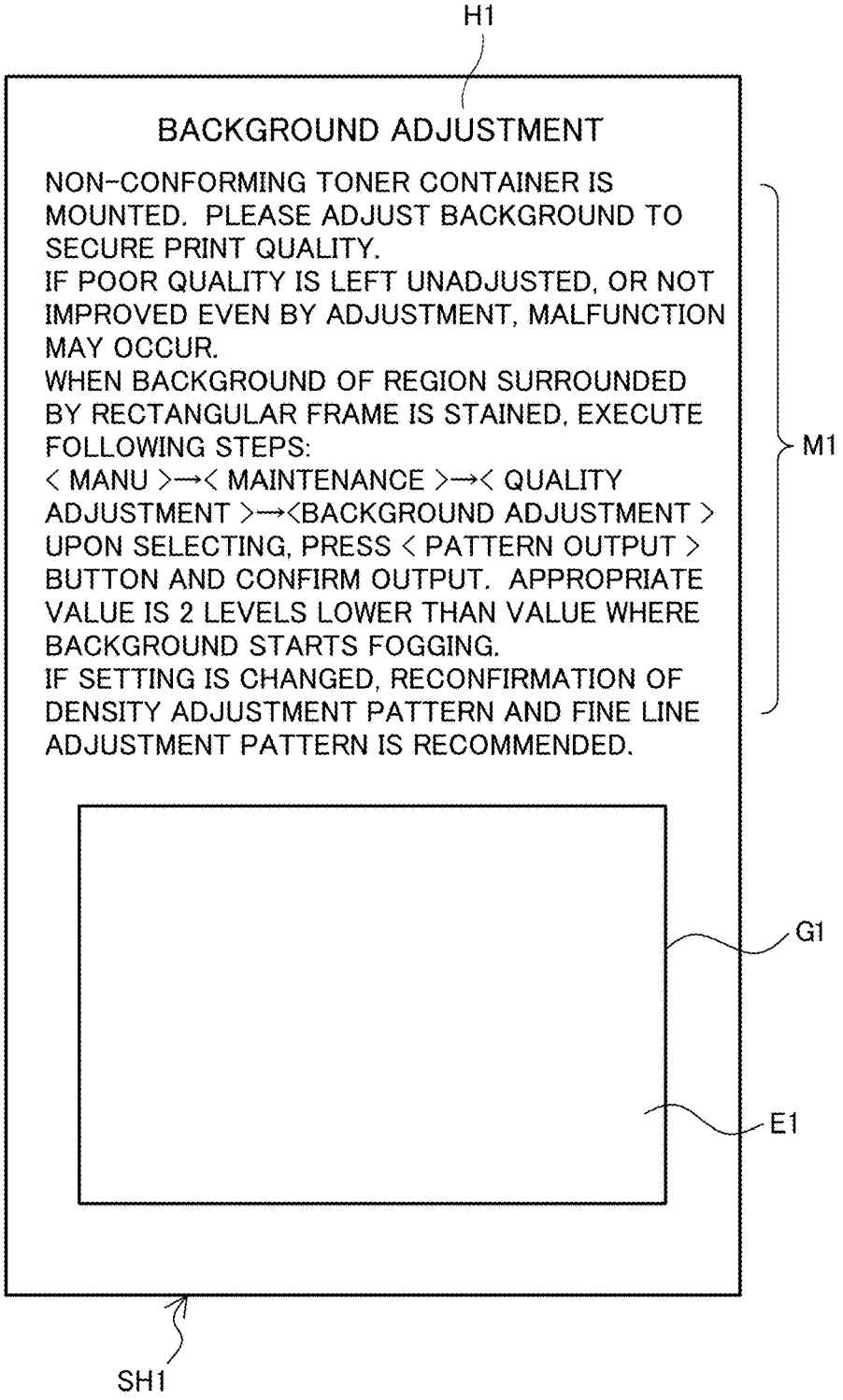
FIG. 8 is a schematic drawing showing an example of a quality check sheet related to background adjustment.
Figure 9:
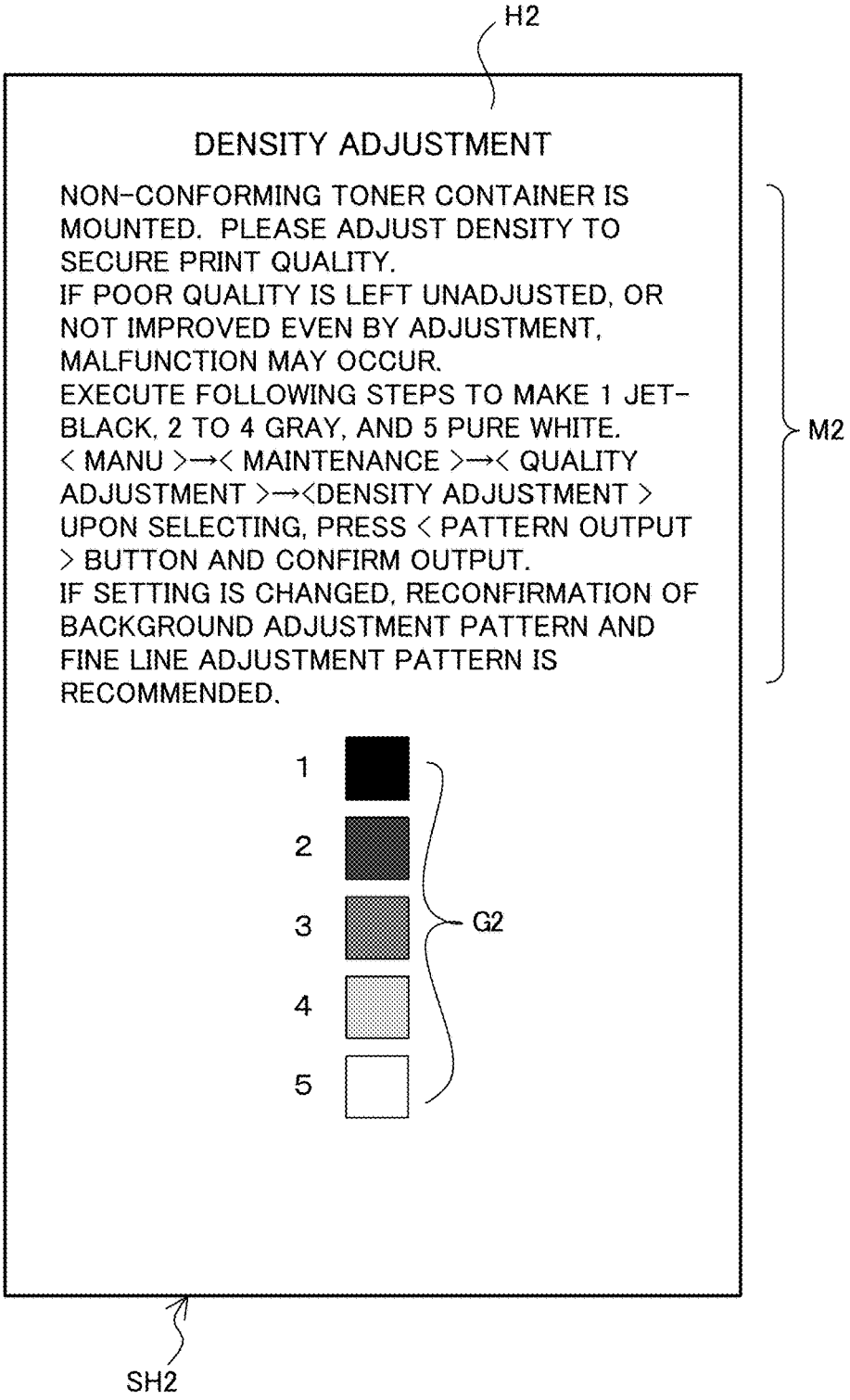
FIG. 9 is a schematic drawing showing an example of a quality check sheet related to density adjustment.
Figure 10:
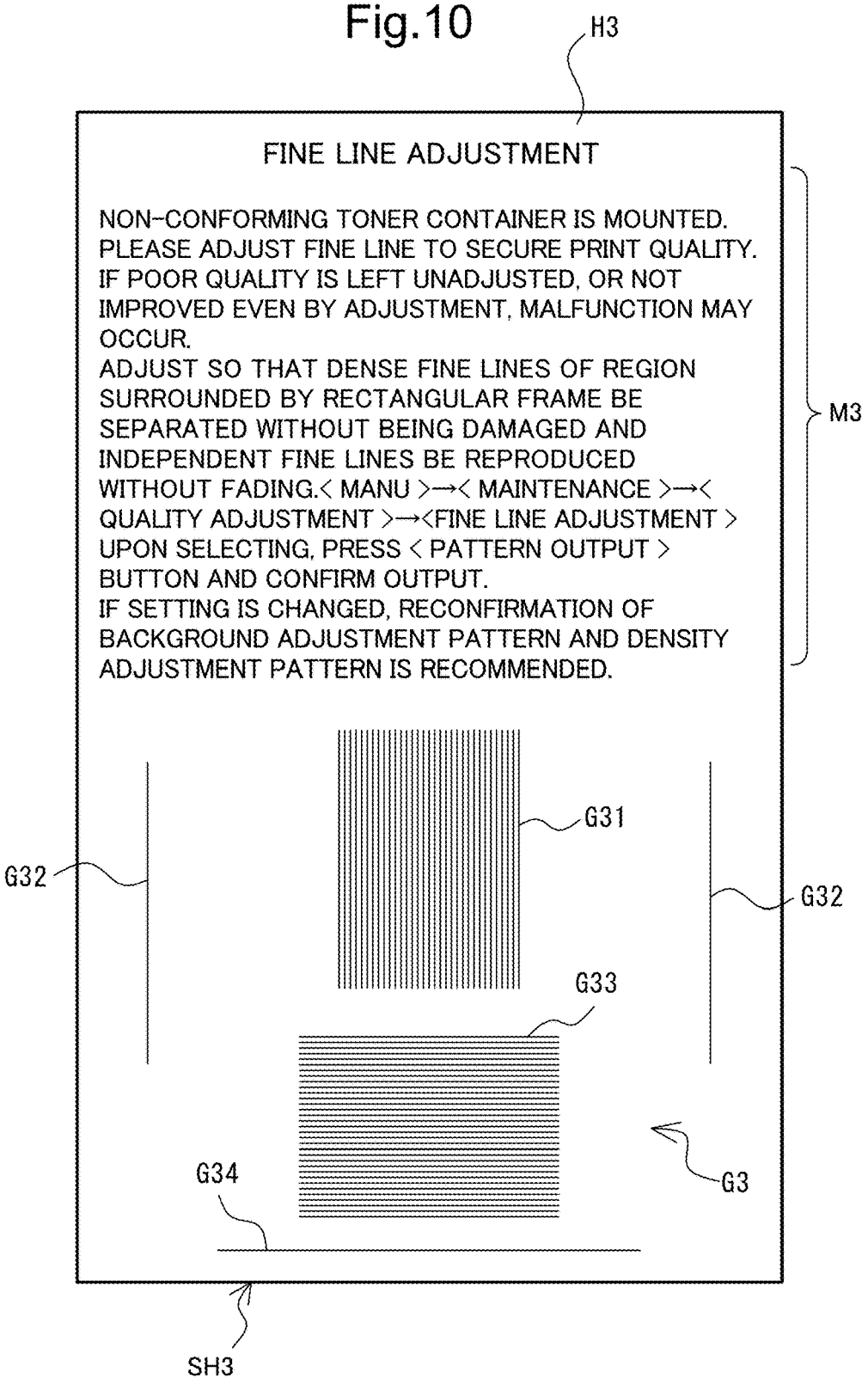
FIG. 10 is a schematic drawing showing an example of a quality check sheet related to fine line adjustment.

FIG. 8 to FIG. 10 each illustrate an example of the quality check sheet. FIG. 8 is related to the background adjustment, FIG. 9 is related to the density adjustment, and FIG. 10 is related to the fine line adjustment.

A sheet SH1 serving as the quality check sheet shown in FIG. 8 includes a title H1 showing "BACKGROUND ADJUSTMENT", a message M1 notifying the user that the non-conforming toner container 17 is used and hence the quality may be degraded, and urging the user to adjust the background, and the image pattern G1 including a frame serving as a feature image, for attracting the user's attention to a predetermined region E1 (for enabling the user to recognize background fogging).

A sheet SH2 serving as the quality check sheet shown in FIG. 9 includes a title H2 showing "DENSITY ADJUSTMENT", a message M2 notifying the user that the non-conforming toner container 17 is used and hence the quality may be degraded, and urging the user to adjust the density, and the image pattern G2. The image pattern G2 includes five patch images different in density from each other, aligned such that the uppermost one is jet black, the second to the fourth ones become gradually lighter, and the lowermost one is pure white, and numbers 1 to 5 located beside the respective patch images, the number 1 indicating jet black, the numbers 2 to 4 indicating gray, and the number 5 indicating pure white.

A sheet SH3 serving as the quality check sheet shown in FIG. 10 includes a title H3 showing "FINE LINE ADJUSTMENT", a message M3 notifying the user that the non-conforming toner container 17 is used and hence the quality may be degraded, and urging the user to adjust the fine lines, and the image pattern G3. The image pattern G3 includes a plurality of fine lines G31 extending in the longitudinal direction of the sheet SH3 (exemplifying the predetermined direction in What is claimed is) and aligned parallel to each other, a pair of fine lines G32 extending in the longitudinal direction of the sheet SH3 independent from the plurality of fine lines G31, a plurality of fine lines G33 extending in the width direction of the sheet SH3 (exemplifying the direction orthogonal to the predetermined direction in What is claimed is) and aligned parallel to each other, and a fine line G34 extending in the width direction of the sheet SH3 independent from the plurality of fine lines G33.

After generating and outputting the quality check sheet, the controller 100 resets the counter C to 0 (S13), and also resets the timer T to 0 (S14). Then the operation returns to S2. In the case where the controller 100 decides at S11 that the predetermined period TA has not elapsed in the timer T also (NO at S11), the operation returns to S2, where it is decided whether the toner container 17 has been replaced, according to the information acquired from the mounting/removal sensor 22.

Upon deciding that the toner container 17 has not been replaced (NO at S2), the controller 100 decides whether the flag F is 1 (S15).

When the controller 100 decides that the flag F is 1 (YES at S15), it can be assumed that the toner container 17 mounted in the main body 11 is the non-conforming product, and hence the operation returns to S8. After going through YES at S8 and S9, the controller 100 generates and outputs the quality check sheet, in the case of deciding that it is an appropriate time for generating and outputting the quality check sheet (YES at S10, or at S11) (S12).

In contrast, when the controller 100 decides that the flag F is not 1 (i.e., flag F is 0) (NO at S15), it can be assumed that the toner container 17 mounted in the main body 11 is the conforming product, and hence it is unnecessary to generate and output the quality check sheet. Accordingly, the operation returns to S2.

When the conformity decision unit 103 decides at S3 that the toner container 17 mounted in the main body 11 is not the non-conforming product (i.e., is the conforming product) (NO at S3), the controller 100 decides whether the flag F is 1 (S16).

When the controller 100 decides at this point that the flag F is 1 (YES at S16), the controller 100 sets the flag F to 0 (S17), and then returns to S2. In contrast, when the controller 100 decides that the flag F is not 1 (i.e., flag F is 0) (NO at S16), it is unnecessary to change the flag F, and hence the operation directly returns to S2.

With the configuration according to the first embodiment, in the case where a non-conforming toner container 17 is mounted in the main body 11, the quality check sheet is outputted for the confirmation by the user, each time the predetermined number of sheets CA have been printed, or each time the predetermined period TA has elapsed, whichever comes first. Accordingly, the user can adjust the quality according to the content of the quality check sheet, even though the quality is degraded owing to the use of the non-conforming toner container 17. Therefore, the image can be amended to a proper quality, despite the quality being degraded because of the non-conforming toner container 17. As described above, the quality check sheet includes, for example, the image patterns G1 to G3 for indicating the quality level of the image to be formed on the sheet SH, and the messages M1 to M3 for urging the user to adjust the quality of the image to be formed on the sheet SH.

Thus, when the non-conforming toner container 17 is mounted in the main body 11, the user is periodically urged to confirm the quality level of the image to be formed on the sheet SH and adjust the quality, and therefore the quality degradation is prevented from being left uncorrected for a long time, despite the quality being degraded owing to the user of the non-conforming toner container 17. Consequently, even though the non-conforming toner container 17 is mounted in the image forming apparatus 1, stable image formation can be performed, and malfunction of the image forming apparatus 1 can be prevented.

Now, with the image forming apparatuses according to the background art, when a non-conforming toner container is used and hence the image forming apparatus becomes unable to exhibit the expected performance, quality degradation of the image may be incurred, such as background fogging originating from insufficiently charged toner sticking to the sheet, incorrect density, and poor reproduction of characters and fine lines. In addition, the quality degradation for a long time may lead to malfunction of the image forming apparatus. The conforming product refers to those products that satisfy the specified condition for use, and thus enable the image forming apparatus to exhibit the fullest performance, such as a genuine product and a regular product.

The background fogging is, presumably, caused by an excessive amount of toner sticking to the surface of the photoconductor drum. Accordingly, when the background fogging continues to appear, in other words an excessive amount of toner continuously sticks to the surface of the photoconductor drum, an increased amount of toner splashes, and thus stains the exposure device, the transfer roller, the fixing device, and the transport route along which the sheet is transported. In addition, the cleaning device collects a larger amount of toner, which may provoke clogging of the toner collection path.

Further, in the case where incorrect density, such as excessive darkening of the density, or thickened characters and fine lines with the clearances lost continuously appear, the exposure device, the transfer roller, the fixing device, and the transport route may be stained with the toner, and the toner collection path may be clogged with the toner, as in the case of the background fogging.

Conversely, when the density continues to be excessively light for a long time, the developing agent (or toner) may be deteriorated, and the toner may run short. For example, when the developing agent is a single-component developing agent without a magnetic carrier, the lowering of the density leads to a decrease in amount of the toner emitted from the developing device, and hence the amount of the toner supplied to the developing device is also decreased. Accordingly, a decreased amount of toner is replaced in the developing device, and thus the toner resides in the developing device. The toner residing in the developing device becomes more prone to be deteriorated, and therefore the lowering of the density results in deterioration of the toner.

Further, the toner also serves as an abrasive for polishing the surface of the photoconductor drum. Accordingly, when the toner runs short and the photoconductor drum is insufficiently polished, filming or image blur may be incurred, owing to the improper polishing. In addition, when characters become patchy, or fine lines become finer for a long time also, the filming or image blur becomes more prone to be incurred, as in the case of incorrect density.

In the image forming apparatus according to the background art, a warning message notifying the user to the effect that a non-conforming toner container has been mounted is displayed on the display panel. However, when the user ignores the warning message and continues to use the non-conforming toner container, the image forming apparatus may become unable to exhibit its fullest performance, or may even malfunction. In particular, in the case where the toner of a conforming product and the toner of a non-conforming product are mixed, the foregoing defects become more prone to be incurred.

With the configuration according to this embodiment, in contrast, stable image forming operation can be performed and the malfunction of the image forming apparatus can be prevented, despite a non-conforming toner container being used.

In the first embodiment, the controller 100 both counts the number of sheets printed and measures the elapsed time, and presents the quality check sheet (sheets SH1 to SH3) to the user each time the predetermined number of sheets CA have been printed, or each time the predetermined period TA has elapsed, whichever comes first. Alternatively, the controller 100 may be configured to perform only either of the counting of the number of sheets printed and the measurement of the elapsed time, and generate and output the quality check sheet, each time the predetermined number of sheets CA have been printed, or each time the predetermined period TA has elapsed.

However, frequently presenting the quality check sheet to the user to urge the user to adjust the quality, as in the first embodiment, more effectively facilitates the image quality to be maintained, and different mixture ratios of the toner of a conforming product and the toner of a non-conforming product, or seasonal variations of the environment of use, to be appropriately managed. Further, to maintain the image quality with higher accuracy, the controller 100 may be configured to reduce the predetermined number of sheets CA to be counted, or shorten the predetermined period TA to be measured. In this case, the user is more frequently urged to adjust the quality.

Figure 11:
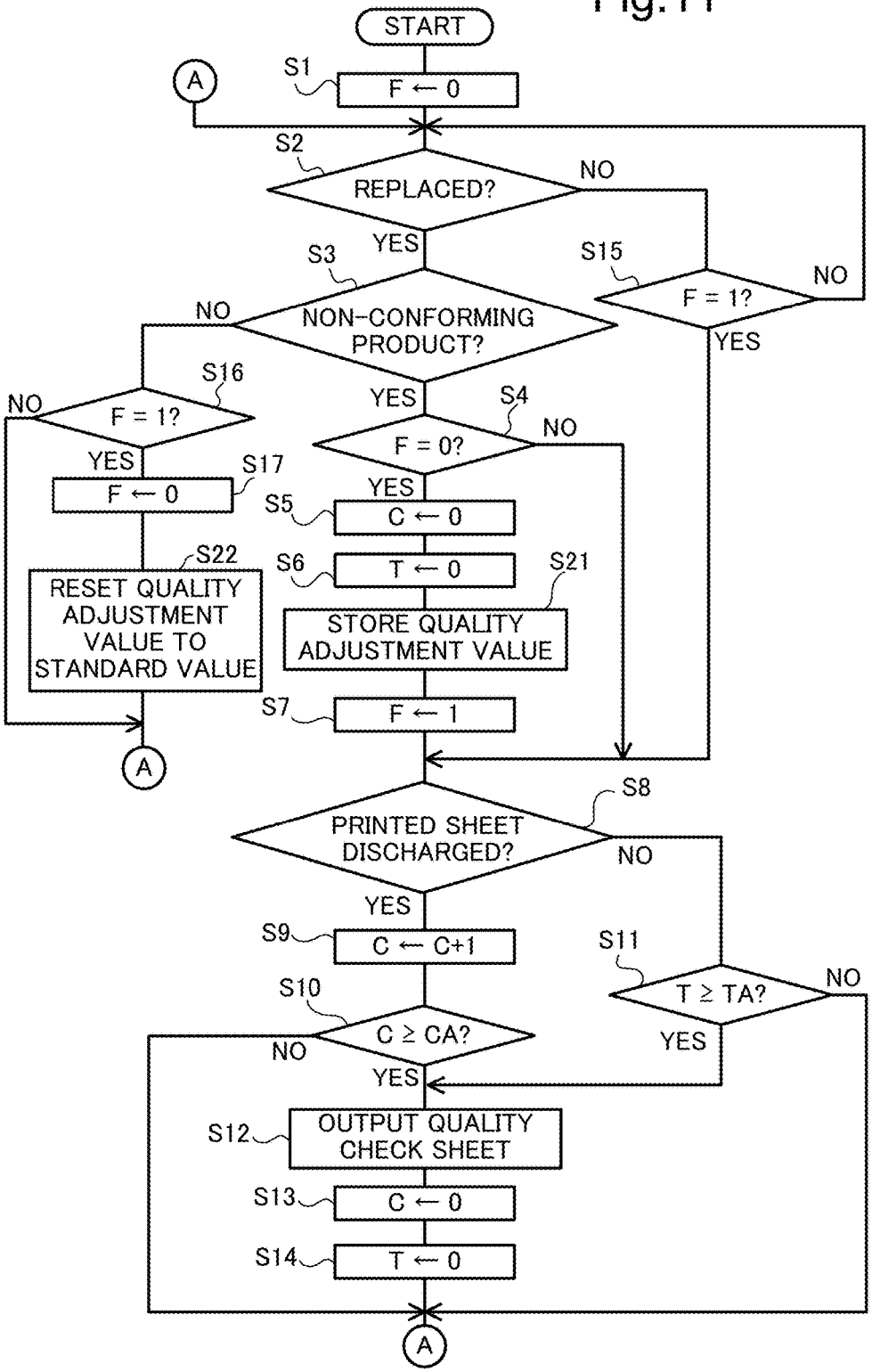
FIG. 11 is a flowchart showing an example of an operation performed by a control unit of an image forming apparatus according to a second embodiment.

Referring now to the flowchart shown in FIG. 11, an example of the operation performed by the control unit 10 of the image forming apparatus 1 according to a second embodiment will be described hereunder. The steps other than S21 and S22 are similar to those of the first embodiment, and therefore the description of those steps will not be repeated.

When the controller 100 decides that the toner container 17 has been replaced at S2 (YES at S2), the conformity decision unit 103 decides that the toner container 17 mounted in the main body 11 is a non-conforming product at S3 (YES at S3), and the controller 100 decides that the flag F is 0 at S4 (YES at S4), it can be assumed that the conforming toner container 17 mounted in the main body 11 has been replaced with a non-conforming product. Therefore, the controller 100 resets the counter C and the timer T to 0 (S5, S6), and stores the current quality adjustment value, in other words the quality adjustment value that has been used until the conforming toner container 17 in the main body 11 is replaced with the non-conforming product, as a standard value (S21), and then sets the flag F to 1 (S7).

In contrast, when the controller 100 decides that the toner container 17 has been replaced at S2 (YES at S2), the conformity decision unit 103 decides that the toner container 17 mounted in the main body 11 is not a non-conforming product (i.e., is a conforming product) at S3 (NO at S3), and the controller 100 decides that the flag F is 1 at S16 (YES at S16), it can be assumed that the non-conforming toner container 17 mounted in the main body 11 has been replaced with a conforming product. Therefore, the controller 100 resets the flag F to 0 (S17), and resets the quality adjustment value to the standard value stored at S21 (S22).

In the second embodiment, the quality adjustment value, used before the conforming toner container 17 mounted in the main body 11 was replaced with the non-conforming product, is stored as the standard value, and when the non-conforming toner container 17 mounted in the main body 11 is replaced with the conforming product, the quality adjustment value is reset to the standard value.

Here, although the non-conforming toner container 17 is replaced with the conforming product, the toner in the developing device 124 is still the non-conforming product immediately after the replacement, and then the non-conforming toner in the developing device 124 is gradually replaced with the conforming toner. Though the period necessary for complete replacement depends on the size of the developing device 124, approximately 20000 to 30000 sheets have to be printed, in the case of a developing device that employs a popular magnetic single-component developing agent.

Accordingly, as another embodiment, when the controller 100 decides that the non-conforming toner container 17 mounted in the main body 11 has been replaced with the conforming product, according to the decision result provided by the conformity decision unit 103, the controller 100 may reset the quality adjustment value to the standard value, over a predetermined time and by predetermined increments, for example obtained by equally dividing the difference between the quality adjustment value and the standard value, into a plurality of segments. Here, the standard value referred to above is also the quality adjustment value that was set while the conforming toner container 17 was mounted in the main body 11, in other words before the conforming toner container 17 was replaced with the non-conforming product.

The predetermined time may be, for example, the time necessary for the toner in the developing device 124 to be replaced. Such a period may be set, for example, according to the time necessary for printing approximately 20000 to 30000 sheets.

In addition, although the non-conforming toner container 17 is replaced with the conforming product, the controller 100 may generate and output the quality check sheet, until the quality adjustment value is reset to the standard value. Further, the quality check sheet generated at this point may include such a message as "A non-conforming toner has been used thus far. The developing device still contains non-conforming toner. Please adjust quality to secure print quality. If poor quality is left unadjusted, or not improved even by adjustment, malfunction may occur".

However, the user may feel uncomfortable, when the quality check sheet continues to be presented despite the non-conforming toner container 17 having been replaced with the conforming product. Therefore, when the non-conforming toner container 17 is replaced with the conforming product, the controller 100 may generate and output the last mentioned quality check sheet only once after the toner container 17 is replaced.

As still another embodiment, when the controller 100 decides that the non-conforming toner container 17 mounted in the main body 11 has been replaced with the conforming product, according to the decision result provided by the conformity decision unit 103, the controller 100 may compare the quality adjustment value set at this point with the standard value, and immediately reset the quality adjustment value to the standard value, without taking time, when the difference between these values is within a predetermined range (e.g., a difference of one level according to the levels shown in FIG. 6A to FIG. 6C).

The disclosure is not limited to the foregoing embodiments but may be modified in various manners. Although the image forming apparatus according to the disclosure is exemplified by the printer in the foregoing embodiment, the disclosure is broadly applicable to different apparatuses, such as a multifunction peripheral having a plurality of functions, such as copying, printing, scanning, and facsimile transmission, and other image forming apparatuses such as a copier and a facsimile machine.

Further, the configurations and arrangements described with reference to FIG. 1 to FIG. 11 are merely an embodiment of the disclosure, and in no way intended to limit the configurations and arrangements of the disclosure.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a transport unit including a roller pair that transports a sheet, and a transport route on which the roller pair is provided;

an image forming unit including an image carrier that rotates about a rotation shaft and carries a toner image on a surface, and a developing device that forms the toner image on the surface of the image carrier by supplying toner to the image carrier, and configured to form an image on the sheet;

an output tray that receives the sheet on which the image has been formed by the image forming unit;

a toner container removably mounted in a main body, and configured to store the toner used by the image forming unit to form the image; and a processor that realizes a function of:

a conformity decision unit that decides whether the toner container mounted in the main body is a conforming product;

a change reception unit that receives a change of a quality adjustment value from a user; and a controller that causes the transport unit and the image forming unit, when the conformity decision unit decides that the toner container mounted in the main body is not a conforming product, to discharge a quality check sheet, formed by printing at least one of a predetermined image pattern and a predetermined message on the sheet, to the output tray, each time a predetermined number of sheets have been printed, or each time a predetermined time has elapsed, wherein the predetermined image pattern is for indicating a quality level of the image to be formed on the sheet, the predetermined message is for urging the user to adjust the quality of the image to be formed on the sheet, and the controller controls the transport unit and the image forming unit according to the quality adjustment value that has been changed and received by the change reception unit.

2. The image forming apparatus according to claim 1, wherein the predetermined image pattern includes a feature image for attracting attention of the user to a predetermined region, and the predetermined region causes the user to recognize fogging of background.

3. The image forming apparatus according to claim 2, wherein the change reception unit receives from the user a change of a background adjustment value for adjusting the background, as the quality adjustment value, and the controller controls a surface potential of the image carrier according to the changed background adjustment value received by the change reception unit.

4. The image forming apparatus according to claim 1, wherein the predetermined image pattern includes a plurality of patch images different in density from each other.

5. The image forming apparatus according to claim 4, wherein the change reception unit receives from the user a change of a density adjustment value for adjusting image density, as the quality adjustment value, and the controller controls an AC component of development bias applied between a developing roller in the developing device and the image carrier, according to the changed density adjustment value received by the change reception unit.

6. The image forming apparatus according to claim 1, wherein the predetermined image pattern includes:

a plurality of fine lines extending in a predetermined direction of the sheet and aligned parallel to each other;

a fine line independent from the plurality of fine lines and extending in the predetermined direction of the sheet;

a plurality of fine lines extending in a direction orthogonal to the predetermined direction and aligned parallel to each other; and a fine line independent from the plurality of fine lines and extending in the direction orthogonal to the predetermined direction of the sheet.

7. The image forming apparatus according to claim 6, wherein the change reception unit receives from the user a change of a fine line adjustment value for adjusting the fine lines, as the quality adjustment value, and the controller controls a DC component of development bias applied between a developing roller and the image carrier, according to the changed fine line adjustment value received by the change reception unit.

8. The image forming apparatus according to claim 1, wherein the predetermined message includes a reason that the sheet on which the message is formed has been outputted to the output tray.

9. The image forming apparatus according to claim 1, wherein the predetermined message includes a method of adjusting the image quality.

10. The image forming apparatus according to claim 1, wherein the controller outputs the quality check sheet to the output tray, each time the predetermined number of sheets have been printed, or each time the predetermined period has elapsed, whichever comes first.

11. The image forming apparatus according to claim 10, wherein, when the controller decides that a non-conforming toner container mounted in the main body has been replaced with the conforming product, according to a decision result provided by the conformity decision unit, the controller continues to generate and output the quality check sheet, until the quality adjustment value is reset to a standard value.

12. The image forming apparatus according to claim 10, wherein, when the controller decides that a non-conforming toner container mounted in the main body has been replaced with the conforming product, according to a decision result provided by the conformity decision unit, the controller immediately resets the quality adjustment value to a standard value, in a case where a difference between the quality adjustment value used until the decision was made and the standard value is within a predetermined range.

13. The image forming apparatus according to claim 1, wherein, when the controller decides that a non-conforming toner container mounted in the main body has been replaced with the conforming product, according to a decision result provided by the conformity decision unit, the controller resets the quality adjustment value to a standard value, over a predetermined time and by predetermined increments, and the standard value is the quality adjustment value that was set before the conforming toner container mounted in the main body was replaced with the non-conforming product, and used while the conforming toner container was mounted.

14. The image forming apparatus according to claim 13, wherein the predetermined time is a time necessary for the toner in the developing device to be replaced.

* * * * *